United States Patent [19]

Milde

[11] 4,183,736

[45] Jan. 15, 1980

[54] ELECTROSTATIC PRECIPITATION

[75] Inventor: Helmut I. Milde, Andover, Mass.

[73] Assignee: High Voltage Engineering Corporation, Burlington, Mass.

[21] Appl. No.: 710,383

[22] Filed: Aug. 2, 1976

Related U.S. Application Data

[60] Division of Ser. No. 521,788, Nov. 7, 1974, abandoned, which is a continuation-in-part of Ser. No. 281,405, Aug. 17, 1972, abandoned.

[51] Int. Cl.[2] ..... B03C 3/41; B03C 3/66

[52] U.S. Cl. ..... 55/139; 55/154; 361/235

[58] Field of Search ..... 55/2, 12, 13, 105, 108, 55/110, 112, 117, 118, 119, 120, 123, 139, 150, 154; 361/235

[56] References Cited

U.S. PATENT DOCUMENTS

| | | | |
|---|---|---|---|
| 1,959,374 | 5/1934 | Lissman | 55/139 |
| 1,978,426 | 10/1934 | Hahn | 55/139 |
| 1,992,113 | 2/1935 | Anderson | 55/123 |
| 2,000,017 | 5/1935 | Heinrich et al. | 55/139 |
| 2,000,019 | 5/1935 | Heinrich et al. | 55/2 |
| 2,000,020 | 5/1935 | Heinrich | 55/2 |
| 2,251,451 | 8/1941 | Heinrich | 55/139 |
| 2,326,237 | 8/1943 | Lissman | 55/139 |
| 2,440,455 | 4/1948 | White | 55/139 |
| 2,682,313 | 6/1954 | White | 55/123 |
| 2,782,867 | 2/1957 | Hall | 55/139 |
| 3,066,463 | 12/1962 | Penney | 55/139 |

FOREIGN PATENT DOCUMENTS

| | | | |
|---|---|---|---|
| 404635 | 1/1934 | United Kingdom | 55/139 |
| 1031947 | 6/1966 | United Kingdom | 55/105 |

OTHER PUBLICATIONS

Lõthietal, New Method of Electrostatic Removal of Dust from Gases, pp. 910–913, Chem. Eng. Techn. 39, Jahrg. 1967.

White; Harry J. *Industrial Electrostatic Precipitations,* Addison-Wesley Publishing Co. Inc., Reading, Mass., copyright 1963, pp. 97–101, 105, 108–110, 232–234, 325 and 326.

Felsenthal, Peter and Joseph M. Proud, "Nanosecond-Pulse Breakdown in Gases", Physical Review, Series 2, vol. 139A, No. 6A, Sep. 13, 1965, pp. A1796–A1804, published for the Americal Physical Society by the American Institute of Physics, Prince and Lemon Streets, Lancaster, Pa.

*Primary Examiner*—Frank W. Lutter
*Assistant Examiner*—David L. Lacey
*Attorney, Agent, or Firm*—Russell & Nields

[57] ABSTRACT

An improved procedure is disclosed for the electrostatic precipitation of particulates entrained in a stream of gas between corona electrodes and collecting electrodes. The underlying dc field which serves to charge the particulates and transport them out of the stream is relatively uniform and therefore can be relatively high, while the corona which is required to yield ions to charge the entrained particulates is provided by a high repetitively pulsed electric field between the corona electrodes and the collecting electrodes. Embodiments are presented which suggest the manner in which conventional precipitators may be adapted to the present invention.

2 Claims, 8 Drawing Figures

ELECTROSTATIC PRECIPITATION

This application is a division of application Ser. No. 521,788 filed Nov. 7, 1974, now abandoned which is a continuation-in-part of application Ser. No. 281,405 filed Aug. 17, 1972, now abandoned.

BACKGROUND

Electrostatic precipitation is presently generally accepted as the most practical method of separating solid or liquid particulates from moving volumes of gas in commercial processes. Primarily the precipitation process reduces the incidence of effluent air-polluting agents, aiding in the maintenance of acceptable environmental standards while permitting the use of convenient and economical industrial fuels which would otherwise be contraindicated by ecological considerations. Secondarily, some substances recoverable by precipitation may have economic value in themselves.

However, despite the fact that the basics of electrostatic precipitation have been known for some fifty years and notwithstanding the considerable commercial development of the process through the intervening years, the efficiency of precipitators is still below desirable levels. Thus to attain acceptable anti-pollution standards, precipitators presently must be large and expensive. Some theoretical considerations indicate wherein improvement in performance may be achieved.

The efficiency of an electrostatic precipitator is given by the expression $$\text{eff.} = 1 - e^{-(A/Q)v_d} \quad \text{(i)}$$

where

A=collection area in square meters;

Q=flow rate in cubic meters per second;

$v_d$=drift velocity in meters per second.

Where A and Q are taken as given constraints, as in an existing installation, one can hope to increase efficiency by increasing the drift velocity $v_d$. The drift velocity is given by the expression $$v_d = qE/6\pi\mu r \quad \text{(ii)}$$

where q=charge per particle in coulombs;

E=electric field in volts per meter;

$\mu$=dynamic viscosity in kilograms per meter-second;

r=particle raidus in meters.

Since the viscosity is difficult to adjust, particularly in pre-existing systems, one need increase the average electric field E and particle charge q in order to increase drift velocity. The particles are charged by negative ions formed from ambient gas molecules by means of electron attachment. The charge per particle is given by the expression $$q = \left(1 + 2\frac{E_r - 1}{E_r + 2}\right)\frac{E_r^2}{3 \times 10^8}\left(\frac{t}{t + \frac{4E_o}{Nq_oK}}\right) \quad \text{(iii)}$$

for particles of diameter at least 0.5 microns, where $E_r$=relative dielectric constant of particles;

t=charging time in seconds;

$E_o$=dielectric constant of vacuum=$8.85 \times 10^{-12}$ coul/Vm;

N=ion concentration in ions per cubic meter;

$q_o$=charge of electron $=1.6 \times 19^{-19}$ coul;

K=ion mobility in square meters per volt-second.

Equation (iii) indicates that the particle charge is proportional to the field intensity E. Then from equation (ii) the drift velocity varies with the square of the field intensity, and from equation (i) it is seen that the efficiency is a strong function of the field intensity. A considerable increase in efficiency may be obtained by increasing the average electric field within the precipitator duct.

At present, most precipitators operate at average electric field levels of between 5 and 10 kV/cm. This is between 1/6 and ⅓ of the breakdown field of uniform field gaps in air at atmospheric conditions. In conventional precipitators, this large discrepancy between actual field intensity and ideally attainable intensity is inherent and necessary, since the field must perform the function of providing electrons via corona discharge. Such corona charging requires a nonuniform field in the vicinity of the charging electrodes. Because the highest potential levels cannot exceed the breakdown capacity of the system, the requirement of nonuniformity is met only with the unfortunate concomitant of reduced average electric field, hence reduced particle charging ability and reduced ability of the field to transport particles to the collecting electrodes.

SUMMARY OF THE INVENTION

The present invention increases E by increasing the uniformity of the electric field, so that for given breakdown conditions a higher average electric field can be obtained. Increasing uniformity under dc conditions means that the corona-producing field at the corona wires must be reduced if breakdown is to be avoided, and a substantial increase in uniformity will thus reduce the field at the corona wires to such a degree that the corona current falls to unacceptable levels. The present invention corrects this problem and provides adequate corona current, by superimposing a pulsed field upon the dc field. The function of this pulsed field is to produce corona for supplying charged particles. This occurs during the pulse. However, the charging of the particles to be removed, as well as their removal, occurs continuously, primarily between pulses. In the above formula (iii) q is the charge per particle, where a particle is defined to have a diameter of at least 0.5 micron, and E is the dc field. Therefore, although it is known from prior patents such as Lissman U.S. Pat. No. 1,959,374 that corona may be produced during pulses of relatively high voltage, and although the present invention makes use of that phenomenon, it must be clearly understood that the electric field E which it is the purpose of the invention to raise is not the electric field during the pulse, but rather the average electric field.

Because the invention is concerned with increased efficiency, it inherently requires substantial corona current. Since the charging of particles (to be removed) continues after corona has stopped, the corona current may be supplied in pulses. However, to obtain the necessary average corona current at reasonable pulse voltages, the pulse repetition rate must be relatively high. It is for this reason that my invention must use pulse repetition rates substantially higher than the prior art such as Lissman U.S. Pat. No. 1,959,374 which was concerned with different problems and not with increasing efficiency by increasing the average electric field E.

The present invention involves the separation of the means within the precipitator for (a) charging particulates and transporting particulates to the collecting plates, and (b) providing electrons by corona.

The first function is performed by a relatively uniform dc electric field. (Herein "dc" means unidirectional current not necessarily of constant amplitude and particularly includes fully and partially rectified alternating current.) Since in accordance with the invention the efficiency of charging and transport is increased by a high average field, the electrodes should be designed to induce a uniform, high intensity field. In the conversion of many conventional precipitators to accomplish the objectives of the invention, this will be accomplished by increasing the number and/or diameter of wires in the duct.

The provision of the necessary corona current to charge the particulates, the second above-cited function, is achieved by an independently variable potential superimposed on the dc field. This superimposed potential is of short pulsed duration. The pulsed field thereby induced can be two or three times as great as the underlying dc field, since the breakdown strength of a gas is high with respect to short pulsed potentials. Cf. Felsenthal and Proud, "Nanosecond Pulse Breakdown in Gases", Phys. Rev. 139A, p. 1796 (September 1965).

The separation of charging and transport functions from provision of electrons comprehends a number of advantages:

1. Presently existing electrostatic precipitators can be adapted to the method of the present invention without the necessity of major changes in the installation. The electrical circuitry of this invention may be quite simple; examples are presented and discussed below in connection with FIGS. 1 and 2.

2. In conventional precipitators an operating voltage is chosen close to the breakdown voltage of the gas. If the voltage is lowered significantly, electron production by corona will cease and the precipitator will not function. Thus, the conventional precipitator is very sensitive to electrode contamination, which can affect the operating voltage, In a system in accordance with the present invention, the pulsed field can be chosen sufficiently high that corona current is assured under virtually all operating conditions and the operative range of the dc field is greatly increased.

3. The function of the corona is to provide charge carriers in order to charge the particulates to their equilibrium state. Increasing the number of charge carriers much beyond the minimum level necessary to perform this function adequately yields no significant advantage, serving merely to decrease the time necessary for the particulates to attain the equilibrium charge level. This relation is made quantitative in equation (iii), which indicates that the equilibrium charge depends only on the electric field, particle radius and, to a lesser extent, the dielectric constant of the particle. Since particle charging time to equilibrium (about 2 msec) is already small relative to particle crossing time (typically about 50 msec), increases in efficiency due to more rapid charging are minimal. Moreover, providing too many charge carriers may have a detrimental effect on the efficiency of the system by causing "back corona", which occurs when the resistivity of collected dust is sufficiently high that current passing through the dust layer increases the potential drop across this layer to a value in excess of the electrical breakdown strength of the layer. The phenomenon of "back corona" may be especially troublesome in conventional precipitators when dust resistivity exceeds about $2\times10^8$ ohm-cm.

With the present invention the average value of corona current can be closely regulated independently of the dc field. This can be done by adjusting the superimposed pulsed voltage, pulse width, or pulse repetition rate. Adjusting pulse voltage is the most important of these, since corona production is exponentially related to peak voltage.

DETAILED DESCRIPTION OF THE PREFERRED EMBODIMENTS

Figure 1:
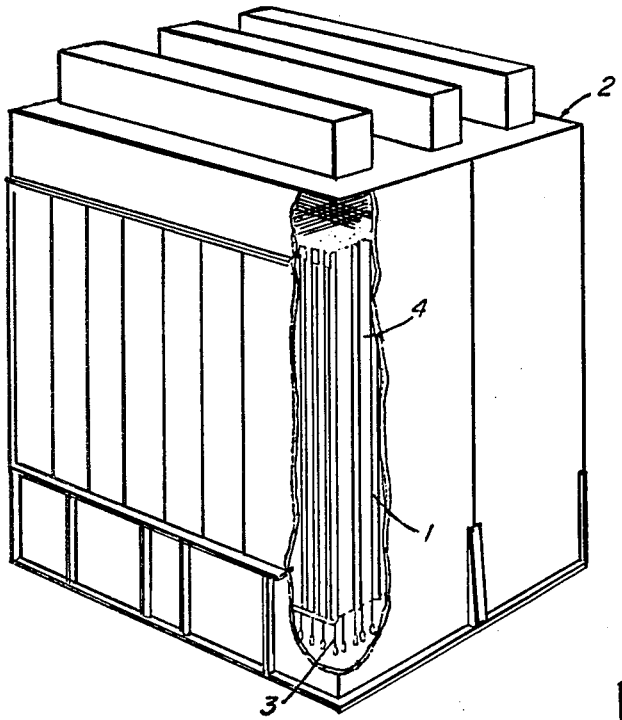
FIG. 1 is a three-dimensional view of a typical duct type precipitator used for collection of fly ash and suitable for use with the invention.
Figure 2:
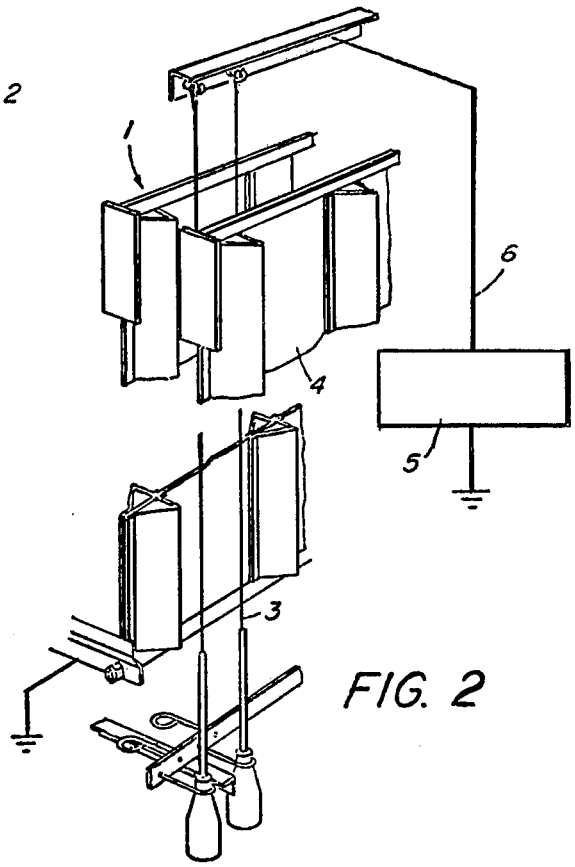
FIG. 2 is an enlarged view of the electrode arrangement for the duct precipitator of FIG. 1.

Referring to FIGS. 1 and 2 of the drawings, therein is shown the electrode configuration 1 of a typical electrostatic precipitator 2. The invention can be used with conventional electrode arrangements, although as hereinafter pointed out it may be desirable to modify conventional electrode arrangements in certain instances. Essentially, an electrostatic precipitator may consist of a single corona wire 3 surrounded by a grounded collector plate 4. A corona discharge created between the wire 3 and the surrounding collector plate 4 produces ions. These ions are then used to charge particulates electrically and this charging of particulates may occur between the corona electrode 3 and the collecting electrode 4, as in Cottrell or single-stage precipitators, or the charging of the particulates may occur in a separate region, which is the so-called two-stage arrangement (not shown). The present invention is useful primarily in single-stage precipitators and the following description will be limited thereto. While simple pipe-type precipitators are used for small gas flows, collection of mist and fogs, and applications requiring water-flushed electrodes, duct-type precipitators having a plurality of corona wires arranged in parallel between a pair of flat collector plates as the precipitation unit are used for larger gas flows, dry collection and sometimes also for water flushed services.

While the present invention is not limited to any particular type of precipitator, it will be described with particular reference to a duct-type precipitator.

In certain household units where production of ozone is undesirable, positive voltage is provided to the corona wire, but in general, industrial units will apply negative voltage to the corona wire 3 by means of a suitable voltage generator 5 which delivers negative voltage to the corona wires by means of a high voltage cable 6, the collecting electrodes or plates 4 generally being grounded. In duct precipitators the collecting plates vary in size from 2 to 3 feet wide by 6 feet high up to 6 or 8 feet wide by 20 to 25 feet high. Typical collecting plates include the so-called Opzel, shown in FIG. 2, or expanded metal, rod curtain and Vee types. Most industrial precipitators use steel or steel alloy corona wires of about 0.1" diameter. Corona currents usually are in the range of 0.01 ma to 1 ma per foot of discharge wire with voltages of the order of 30 Kv to 100 Kv for Cottrell or single stage precipitators.

While basically the voltage supply 5 delivers negative voltage to the corona electrode 3, usually steady direct current is not employed, but rather high voltage unfiltered rectifier sets are used to deliver direct current having a ripple wave form superimposed thereon. Recently, pulse methods somewhat similar to those of high power radar equipment have been proposed which may operate, for example, at 100 microseconds pulse duration with a pulse frequency of 100 per second. Pulse type wave forms are still not in general use, and in general, conventional 60 cycle per second rectifier voltages are used in present day precipitators.

Figure 3:
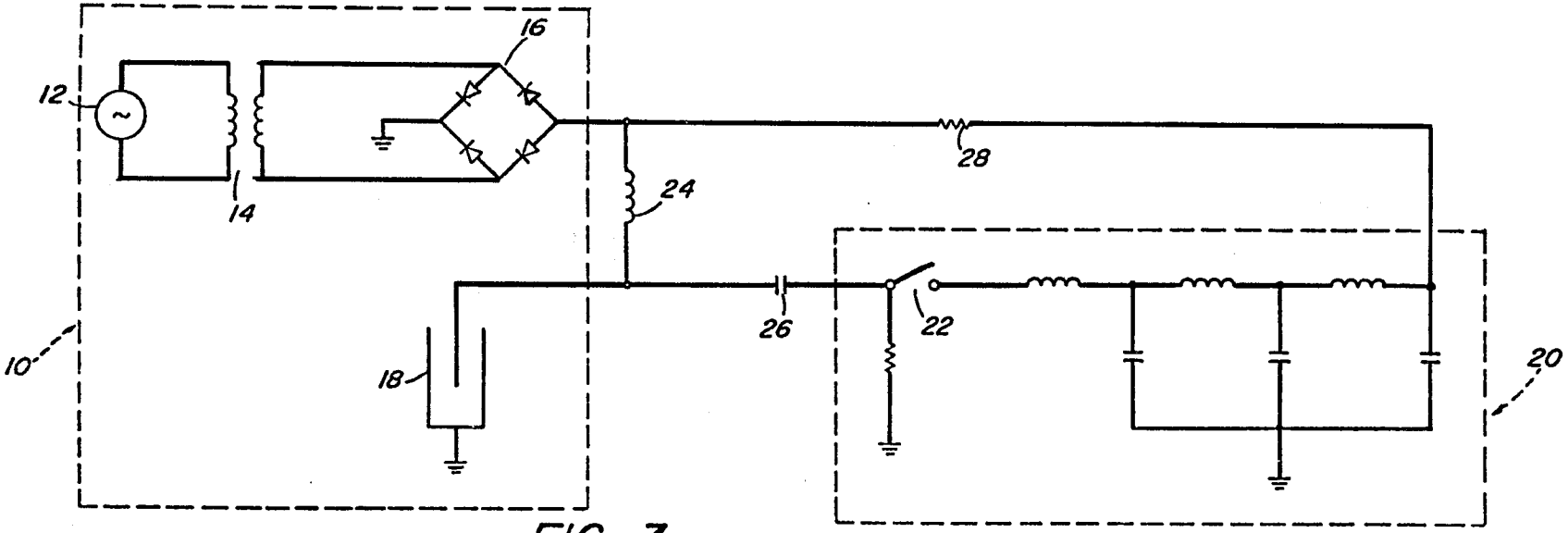
FIG. 3 is a schematic diagram of one circuit embodying the present invention.

One electric circuit which embodies the present invention is diagrammed in FIG. 3. The section indicated at 10 contains the basic components of a conventional electrostatic precipitator. These include an ac power supply 12, a transformer 14 and rectifier 16 to produce a dc waveform which activates the precipitator electrodes 18. The ground potential, collecting electrodes may often comprise a plurality of substantially parallel plates. A number of high potential wire electrodes, parallel to each other and to the plate electrodes, are strung between the plates. The precipitator electrodes are located such that a stream of gases with entrained particulates flows between the plate electrodes and around and past the high potential wires. For example, the electrodes might be located in a chamber through which fuel exhaust gases pass when moving toward an exhaust stack or chimney. In the vicinity of the electrodes, the particulates entrained in the stream of gas become charged and are transported out of the stream to the ground potential, collecting electrodes. The particulates collect on the plates or the floor of the chamber as dust. The collecting electrodes may be of any of a number of different designs deviating from the planar in order to improve collecting properties, reduce particle reentrainment, or otherwise improve precipitator performance. Such variations, for example V-plates, expanded metal plates, rod curtains, Opzel shield plate, etc., are also suitabel for use with the present invention. The precipitator of FIGS. 1 and 2 is merely illustrative of one possible application of the invention.

In combination with the above-recited conventional precipitator elements, the present invention comprehends a pulse forming network, indicated generally at 20, which serves to supply the pulsed corona current. The pulse forming network may be a system of capacitors and inductors, as here illustrated at 20, or a cable, or any suitable pulse generating systems, as may be readily evident to one of ordinary skill in the art. The power supply for the pulse forming network is here taken to be the same as for the underlying dc field, since this may in many cases be convenient; however, alternative power sources may be provided as necessitated by the parameters and design of a particular system. A switch is indicated at 22 which when activated will superimpose the pulse voltage upon the underlying dc waveform. Inductive, capacitative and resistive circuit elements, 24, 26 and 28, respectively, serve as may be necessary to isolate the pulse forming network from the dc circuit.

Information useful in practising my invention is disclosed and claimed in my co-pending application Ser. No. 422,401 filed Dec. 6, 1973.

Figure 4:
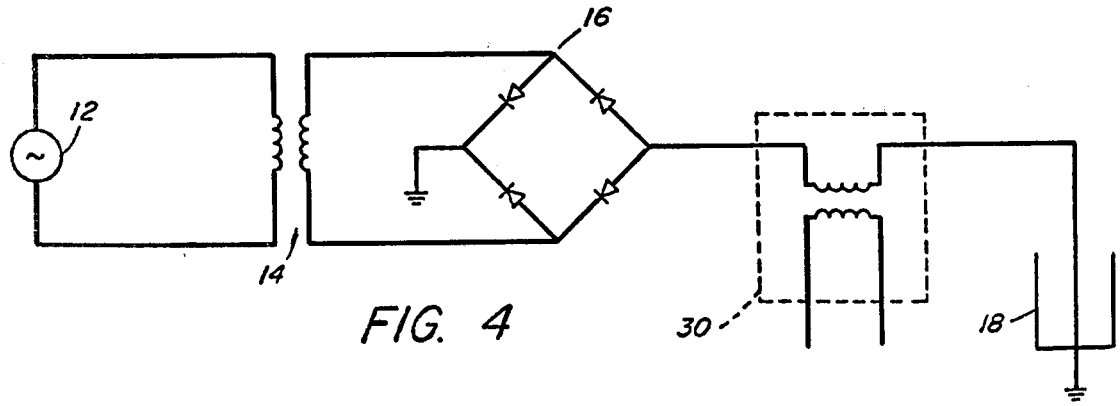
FIG. 4 is a schematic diagram of another circuit embodying the present invention.

Another example is diagrammed in FIG. 4. Here the conventional precipitator circuit, comprising an ac power supply 12, transformer 14, rectifiers 16, and precipitator electrodes 18, is combined in series with a pulse transformer 30 to achieve the superimposed pulsed field.

Figure 6:
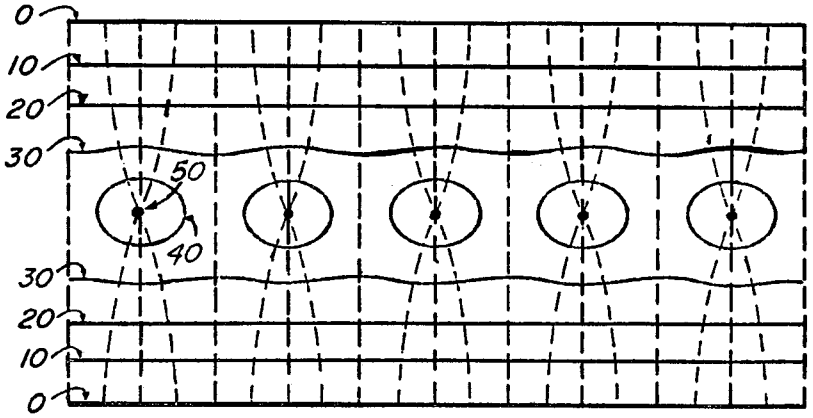
FIGS. 5 and 6 are diagrams indicating the electric field configuration for different wire spacing arrangements between plate electrodes.
Figure 5:
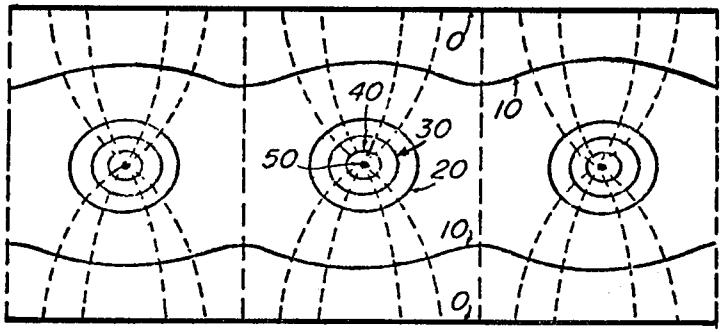

The effect on the electric field of decreasing the spacing between wires in the duct between collecting electrodes is illustrated in FIGS. 5 and 6. In FIG. 5, the corona wires, at a potential level of 50 kV, are spaced 6 inches apart in an 8 inch duct. The solid lines represent equipotential curves. FIG. 6 shows a similar arrangement with corona wires spaced 3 inches apart in the 8 inch duct. The equipotential curves here are more uniformly spaced within the duct and more nearly parallel to the duct plates than in the scheme of FIG. 5. FIG. 5 is representative of the duct and wire spacing of many present day, conventional precipitators. FIG. 6 is a diagram which shows the effect, upon uniformity of the electric field, of reducing wire spacing. As discussed above, the separation of particle charging and transport functions from that of provision of corona current permits the employment of a relatively high, uniform and hence more efficient dc field to accomplish the former function. While it is not feasible to recite generally the optimal wire spacing for the present invention, it may be said that in a typical duct-wire arrangement, the distance between adjacent wires will preferably be less than half the duct width.

The diameter of wire in the duct of a conventional precipitator is generally of a thickness of about 1/10 to $\frac{1}{8}$ inch. Pursuant to the objective of the present invention of obtaining a relatively high potential, uniform dc field, a precipitator embodying the present invention may preferably comprise wire of increased thickness. For example, in many tests, wire of thickness 3/16 to 5/16 inch was found to be suitable in the system of the type diagrammed in FIG. 6. In addition to aiding in obtaining a more uniform dc field, increasing the wire thickness results in reducing vibration and improving fatigue properties of the wires. It should be noted, however, that increasing wire diameter in this manner will alter somewhat the field configuration shown in FIG. 6. Moreover, the wires will not necessarily be of circular cross-section; other shapes, depending on the specific geometry and parameters of the precipitators, may be employed to achieve a desirable dc potential gradient while still permitting the generation of a sufficiently great corona current.

It is known that the electrostatic field in the duct of an electrostatic precipitator depends on the two ratios a/b and c/b, where a is the corona wire radius, b is the wire-to-plate spacing, and c is the wire-to-wire spacing. (See White, Harry J., *Industrial Electrostatic Precipitation,* Addison-Westly Publishing Company, Inc., Reading, Mass. copyright 1963, page 98). In systems of the type diagrammed in FIG. 6, as indicated above, in which b is 4 inches a should be at least 3/32 inch, and c should be at most 3 inches. Therefore, in general, in accordance with the invention a/b should be greater than 3/128 and c/b should be less than $\frac{3}{4}$.

Whereas in a conventional precipitator, such as one which might be associated with the arrangement of FIG. 5, the potential applied to the wires may be about 50 kV, in a precipitator in accordance with the present invention, the potential on the wire may be higher, limited only by the breakdown strength of the gas in the duct. The breakdown strength of the gas sets an upper limit to the electric field or voltage gradient; since the invention achieves more uniform fields, the total voltage may thus be greater for a given maximum voltage gradient. Experiments have shown that voltages of 70 kV or higher on the wire are suitable.

The necessary corona current to provide ions for the charging of the particulates is achieved as a result of the pulsed high potential superimposed by the pulse generating mechanism as exemplified by the pulse forming network, FIG. 3 at 20, and the pulse transformer, FIG. 4 at 30. The pulsed field thereby induced may be significantly higher than the underlying dc field without resulting in gas breakdown within the duct, since the pulsed potential is of short duration.

More specifically, the superimposed voltage will be at least 10% of the underlying dc wire voltage and typically may be of approximately the same magnitude as the dc wire voltage. For example, experiments have shown that in an arrangement similar to that of FIG. 6, a 70 kV pulse superimposed over a 70 kV dc wire potential is suitable.

The superimposed potential will preferably have a pulse width of between $10^{-9}$ and $10^{-5}$ second. A typical pulse width would be on the order of 100 nanoseconds. Experiments with pulse waveforms having a steeply rising front indicate that in such cases the latter part of the waveform contributes relatively little to the corona current. Thus waveforms of varying exponential decay, or even damped oscillating waveshapes, are suitable, and the narrower range of waveforms may be utilized.

The pulse repetition rate of the superimposed potential is related to the uniformity of the average field as determined by parameters such as wire diameter and wire spacing.

Figure 7:
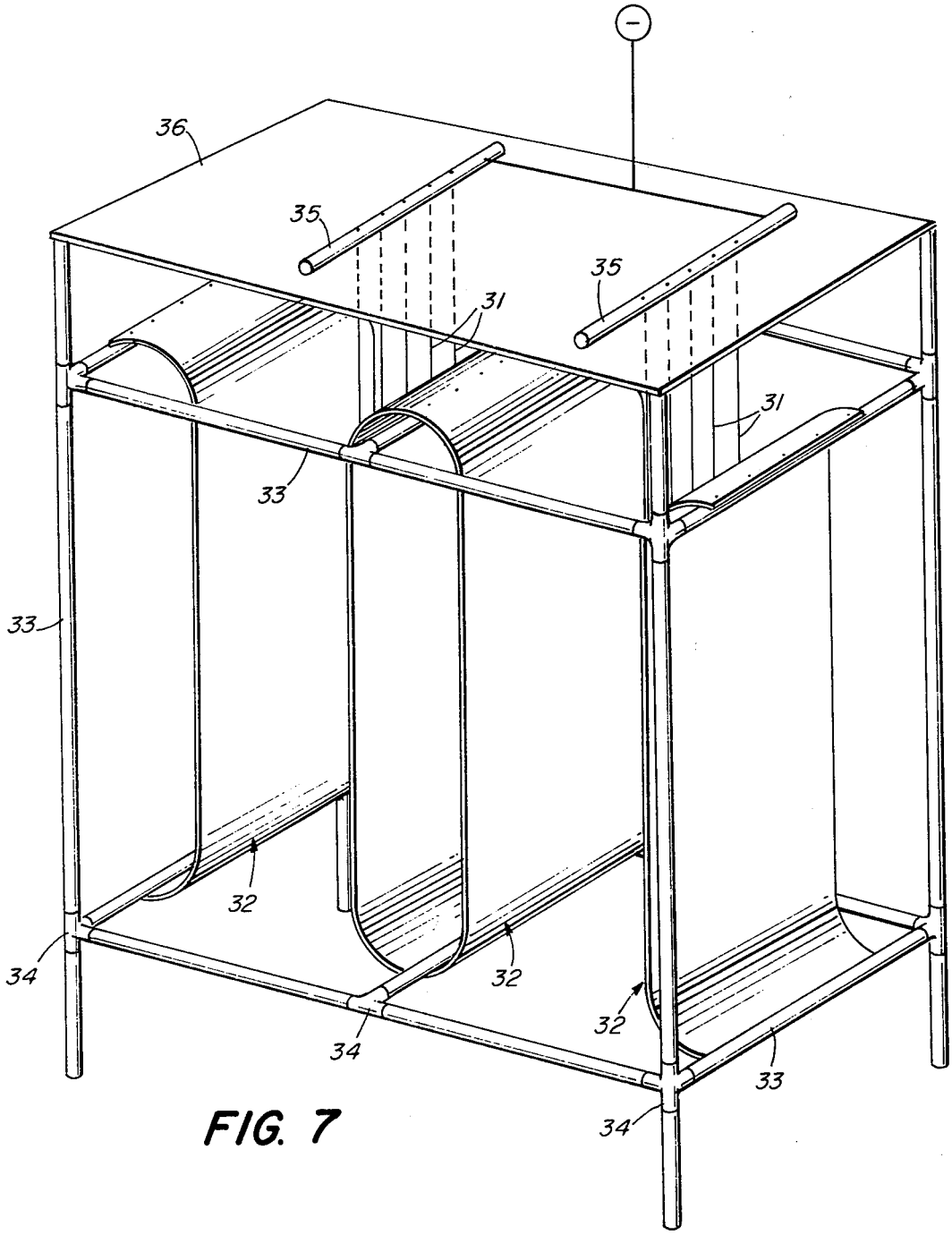
FIG. 7 is a three-dimensional view of apparatus for measuring certain precipitator parameters.
Figure 8:
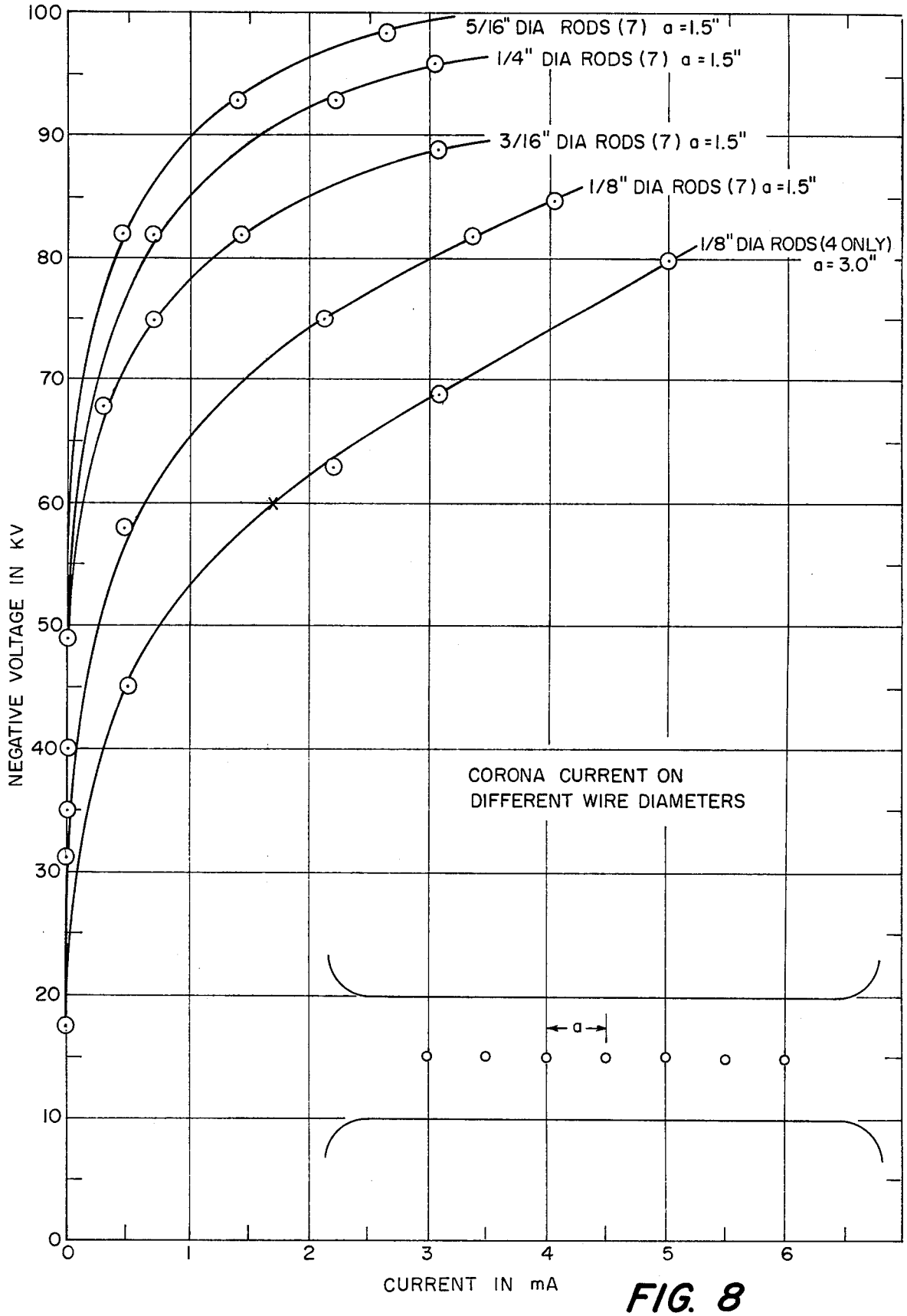
FIG. 8 is a graph showing parameters measured with the apparatus of FIG. 7.

In order to determine the relationship between wire diameter, wire spacing and pulse repetition rate, experiments were performed under my direction making use of the apparatus shown in FIG. 7. That apparatus is structurally similar to a conventional electrostatic precipitator and includes two rows of corona wires 31 and three anode collector plates 32 which are arranged so that each row of corona wires is flanked by a pair of anode plates. High voltage is applied to the corona wires. The anodes are supported upon a simple framework of aluminum tubing members 33 which are fitted together by slip-on pipe fittings 34 as shown. The anodes are made of aluminum sheet. The two rows of corona wires are supported from rigid bars of metal 35 which may comprise the same aluminum tubing and this in turn is supported upon a plate of lucite (polymethyl methacrylate) 36 or other insulating material. In the experiments dc voltage was applied to the corona wires and the resultant dc corona current was measured as a function of voltage. The results are shown in the graph of FIG. 8. Referring thereto one of the curves shows the results for a choice of rod diameter and spacing which corresponds closely to an arrangement commonly used today in electrostatic precipitators. In that arrangement the diameter of the corona wires is $\frac{1}{8}$ inch and the spacing between adjacent wires is 3 inches. In the tests we assumed that a voltage of 60 kV would be representative of a conventional precipitator and the corresponding corona current of 1.7 milliamperes shown in the graph of FIG. 8 is the normal operating current that one requires in order to charge enough particles. This requirement applies whether dc or pulsed voltages are used: that is to say even if in accordance with the invention corona is actually produced only during the pulses, the average corona current is a measure of the charged carriers made available for charging of particles.

The graph of FIG. 8 shows the effect of increasing the diameter of the wires. For example with a 5/16 inch diameter rod and a spacing of 1.5 inches, in order to obtain 1.7 milliamperes a dc voltage of the order of 95 kilovolts would be required. Experiments were conducted then to measure currents produced by 60 kilovolt dc voltages upon which are superimposed 60 kilovolt pulsed voltages at a repetition frequency of 60 pulses per second. For the pulse lengths employed an average of 200 microamperes was measured. Since the current is directly proportional to the pulse repetition frequency for pulses of the same pulse width, this measurement shows that to obtain an average current of 1.7 milliamperes it is necessary to operate the system at a higher pulse repetition frequency; namely, 510 pps. (60 pulses per second $\times$ 1.7 milliamperes $\div$ 0.2 milliamperes), assuming that the pulsed voltage is of the same magnitude as the dc voltage. Further tests were conducted with a lower pulse voltage of 41 kilovolts and the measured average corona current at 60 pps. was approximately 100 microamperes. This suggests that with a 41 kilovolt pulse voltage upon a 60 kV dc voltage a minimum operating frequency would be 1000 pps. In all these experiments the pulse width was of the following nature: the pulse had a fast rising front and an exponential decay with a full-width half-maximum pulse width of 5 microseconds. Narrower pulses would require even faster repetition rates. Since it would not be expected that the pulsed voltages would be of substantially greater magnitude than the dc voltage, the above results show that repetition rates on the order of 500 pps or more are necessary for a staisfactory supply of corona current, and probably 1000 pps is a practical minimum.

It is to be understood that the embodiments of the invention herein described are intended to be illustrative and exemplary and not limiting. It will be apparent to one skilled in the art that deviations from the above-described embodiments may be made to adapt the invention to particular circumstances and parameters and that such adaptations may be made without departing from the spirit of the invention, which is defined in the following claims.

I claim:

1. Apparatus for electrostatic precipitation of particulates by means of a corona current, comprising in combination at least one collecting electrode plate at least one corona electrode array means for establishing a dc voltage between said at least one plate and said at least one array, the geometry of said at least one plate and said at least one array being constructed and arranged so as to produce, upon establishment of said voltage therebetween, an electrostatic field of high intensity and of uniformity sufficient to reduce the field at said at least one corona electrode array to such a degree that the corona current produced thereby is at a level insufficient to precipitate said particulate means for superimposing upon said uniform electrostatic field a superimposed electrostatic field producing a combined field strength sufficiently high to cause corona, said means for superimposing including means for pulsing said superimposed electrostatic field at a pulse repetition rate sufficiently high to provide said corona current at a level so as to precipitate said particulate.

2. Apparatus according to claim 1 wherein the corona-electrode to corona-electrode spacing in the at least one array is less than $\frac{3}{4}$ the corona-electrode to collecting-electrode-plate spacing and the diameter of the corona electrodes is more than 3/128 the corona-electrode to collecting-electrode-plate spacing.

* * * * *